United States Patent [19]

Hunt

[11] 4,171,816

[45] Oct. 23, 1979

[54] GRAMMAR OR LANGUAGE GAME APPARATUS

[76] Inventor: Gene C. Hunt, 1645 E. 92nd St., Chicago, Ill. 60617

[21] Appl. No.: 827,713

[22] Filed: Aug. 25, 1977

[51] Int. Cl.[2] ..... A63F 3/06

[52] U.S. Cl. ..... 273/272; 35/35 H; 35/71; 273/269; 273/299; 273/302

[58] Field of Search ..... 35/35 H, 35 J, 31 F, 35/71; 273/272, 299, 302, 148 A, 269, 273

[56] References Cited

U.S. PATENT DOCUMENTS

| | | | |
|---|---|---|---|
| 942,667 | 12/1909 | Smith | 273/148 A X |
| 1,685,723 | 9/1928 | Robins | 273/272 |
| 2,752,158 | 6/1956 | Brunot et al. | 273/272 |
| 3,191,938 | 6/1965 | Smith | 273/272 |
| 3,389,480 | 6/1968 | Holland | 273/272 |
| 3,394,471 | 7/1968 | Holten | 35/35 H X |

*Primary Examiner*—William H. Grieb

*Attorney, Agent, or Firm*—Lockwood, Dewey, Alex & Cummings

[57] ABSTRACT

An educational and entertaining game apparatus is provided which teaches, tests, and rewards the players' knowledge of grammatical or language concepts and facts such as parts of speech, synonyms, vocabulary, sentence types, punctuation, and verb tenses, while simultaneously providing entertainment for the players. The players match an example of a grammatical or language category with a grammatical or language category selected by chance and accumulate matches to gain points. Some of the matches entitle the players to obtain bonus points calculated by a throw of dice having syllables or words on their faces.

12 Claims, 34 Drawing Figures

FIG. 16
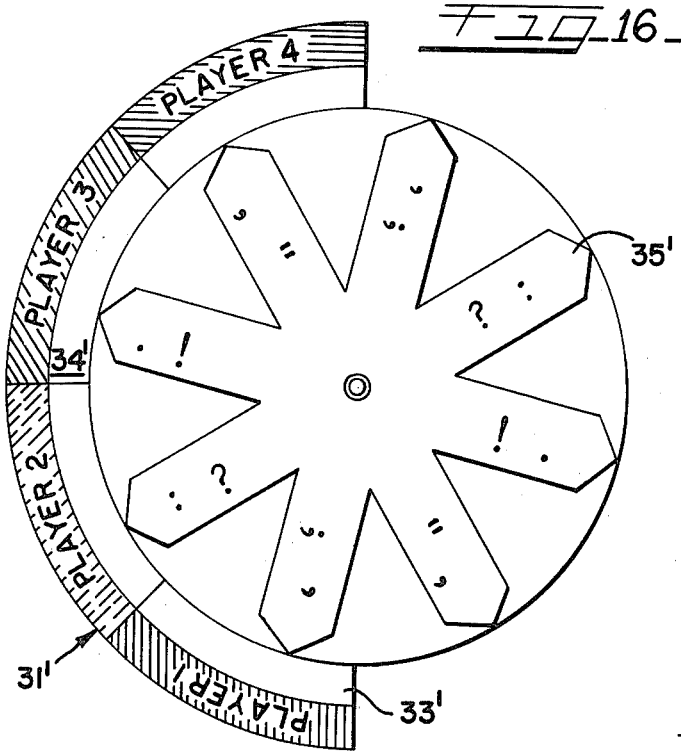
FIG. 34
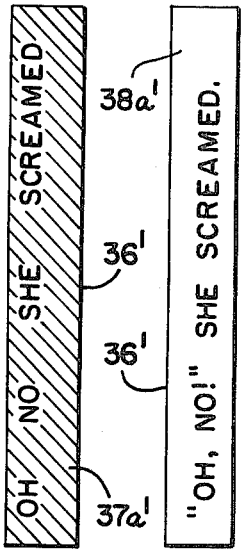
FIG. 33
FIG. 17
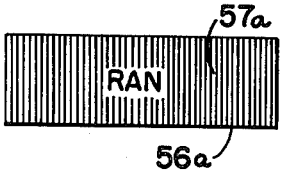
FIG. 18
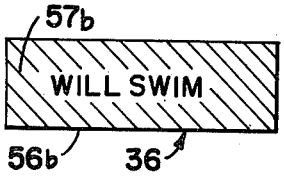
FIG. 21
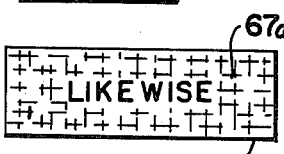
FIG. 22
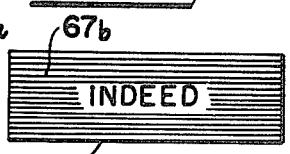
FIG. 19
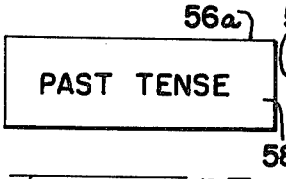
FIG. 20
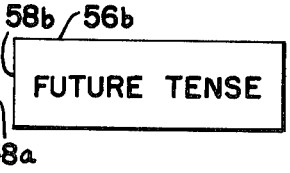
FIG. 23
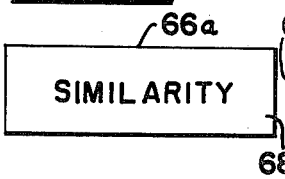
FIG. 24
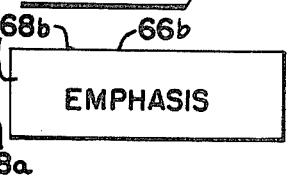
FIG. 25
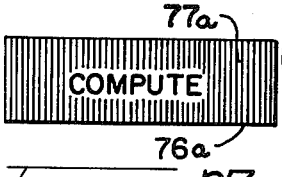
FIG. 26
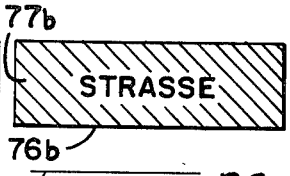
FIG. 29
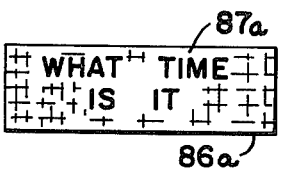
FIG. 30
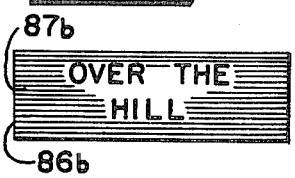
FIG. 27
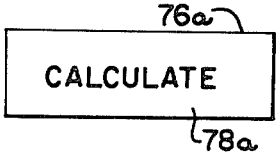
FIG. 28
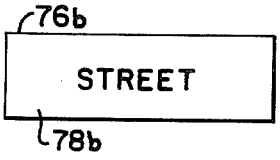
FIG. 31
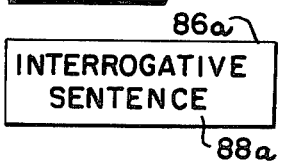
FIG. 32
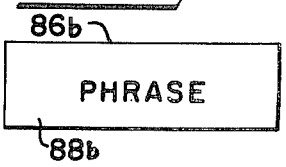

GRAMMAR OR LANGUAGE GAME APPARATUS

BACKGROUND AND DESCRIPTION OF THE INVENTION

This invention generally relates to a game apparatus, and more particularly to a game apparatus for teaching, testing, rewarding, and enjoying language facts and concepts.

Irrespective of the particular language of which they are an essential part, the learning of language or grammer principles and facts is rather tedious and dull for most individuals. In endeavoring to grasp these facts and concepts, individuals have developed and studied rules of grammar, have undertaken numerous written exercises, have engaged in recitations and dialogues, and have memorized acronyms and slogans. Some of these learning aids are more successful and enjoyable than others, and each requires periodic reinforcement to avoid memory loss of the particular facts and concepts with which they deal. There is, accordingly, much to be gained by providing a means which will teach grammatical and/or language concepts and facts in an entertaining manner to thereby not only make more enjoyable the initial learning thereof but also provide an entertainment format by which those facts and concepts may be reinforced through attention-holding exercises which include an interest-generating competitive element.

The present invention provides these advantageous and desirable features in a game apparatus that allows each player to accumulate point totals while identifying and classifying examples of grammatical or language facts and concepts into any one of a number of categories that are specified for each player by a random selection process. Other players are given the opportunity to challenge the correctness of each match, and penalties are assessed for the inaccurate matching of examples and grammatical categories and/or for any unwarranted challenges. Preferably, means are also provided for accumulating bonus points, the amount of which is determined by chance.

It is a general object of the present invention to provide a game apparatus dealing with facts and concepts of grammar or language.

Another object of the present invention is an improved apparatus for promoting the study and self-teaching of facts and concepts of the grammar of any one of a variety of languages.

Another object of the present invention is an improved apparatus for promoting peer group learning of language facts and concepts in an atmosphere that is stimulating, interesting, and challenging.

Another object of the present invention is an improved apparatus for filling leisure time in a manner that encourages parental involvement and provides a means for the participants to think and learn while enjoying themselves.

Another object of this invention is an improved apparatus which provides automatic feedback as to the correctness of a decision concerning language facts and categories, which feedback is reinforced by awarding points for correct answers while subtracting points for incorrect answers.

Another object of the present invention is an improved game apparatus which encourages group participation among the various players by encouraging challenges to the decisions of other players.

Another object of the present invention is to provide an improved game apparatus structure that may be used in teaching any one of a variety of language facts and concepts by merely varying the category labels and the various examples thereof.

These and other objects of the present invention will be apparent from the following detailed description of a preferred embodiment, taken in conjunction with the accompanying drawings wherein.

FIGS. 3, 4, 5, and 6 are plan views of the front face of four different strips illustrating examples of parts of speech.

FIGS. 7, 8, 9, and 10 are plan views of the reverse side of the strips shown in FIGS. 3, 4, 5, and 6, illustrating the respective correct parts of speech categories for each of the strips.

Figure 11:
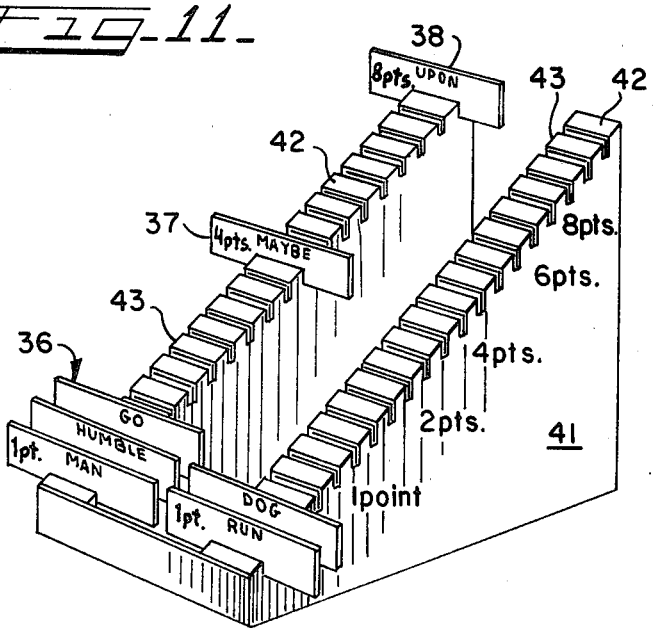

FIG. 11 is a perspective view of an inclined tray for holding and displaying the strips.

Figure 12:
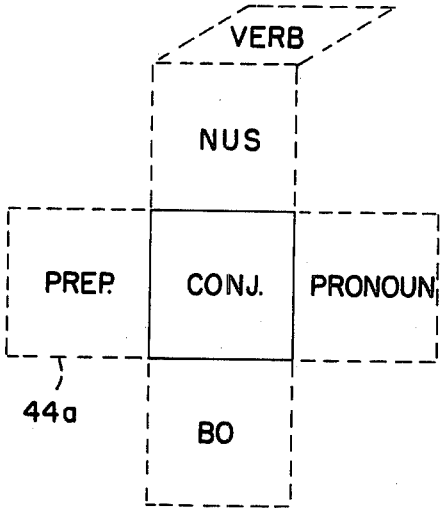
Figure 13:
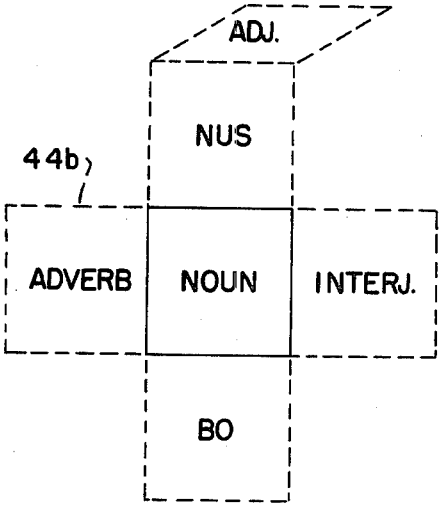

FIGS. 12 and 13 are exploded views of dice showing the six faces of each and illustrating the syllables and also the words relating to the parts of speech grammatical categories.

Figure 14:
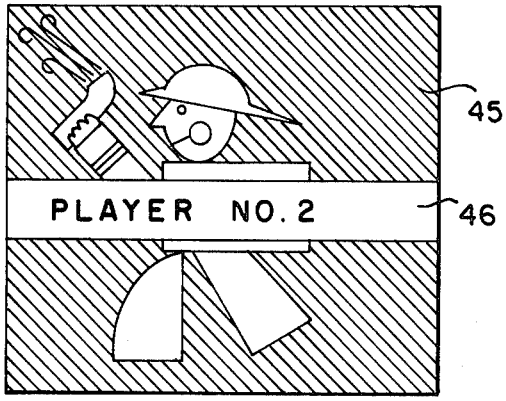

FIG. 14 is a plan view of the front of a player selector card.

Figure 15:
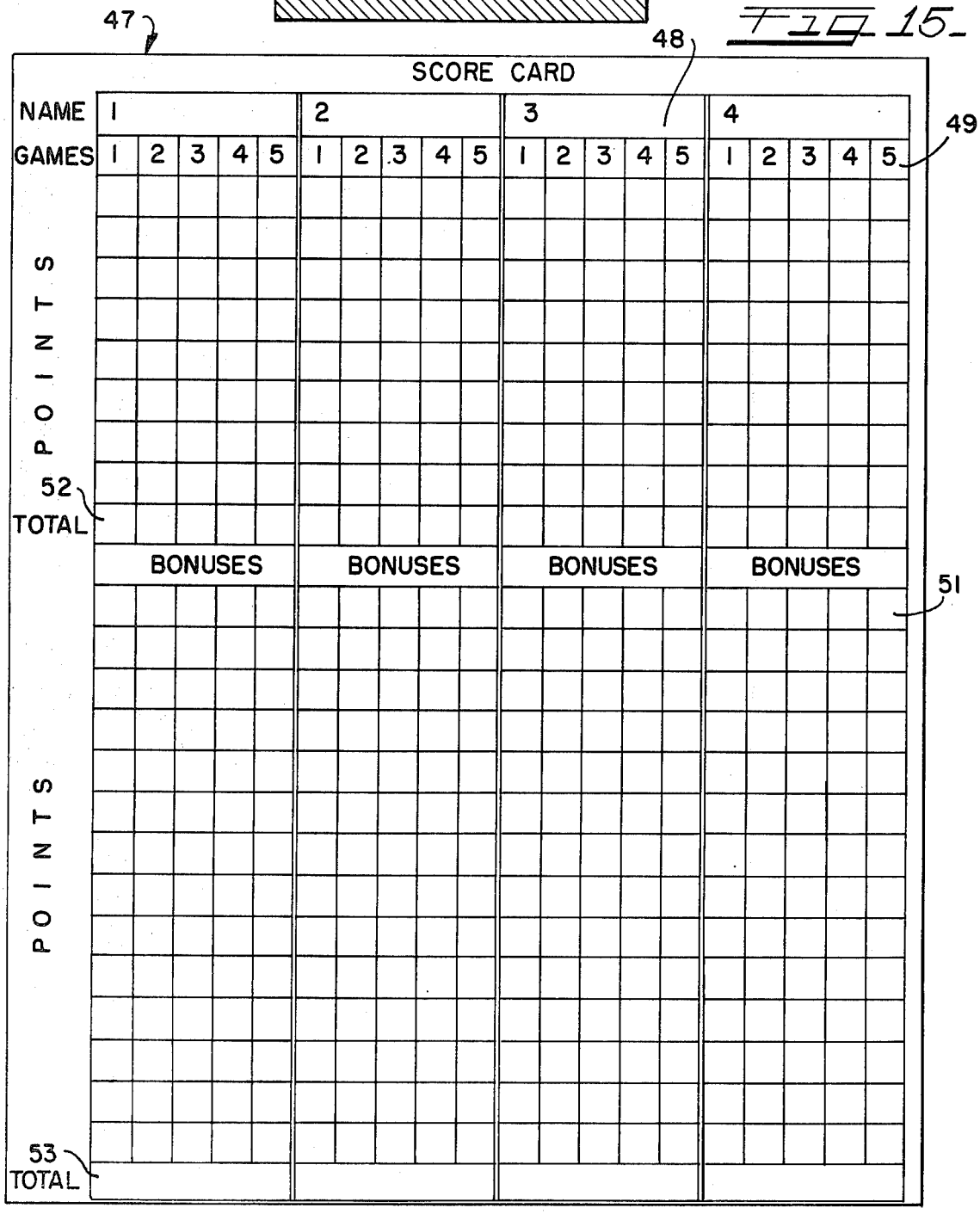

FIG. 15 is a plan view of the preferred score card.

FIG. 16 is a plan view of an alternative indicator means.

FIGS. 17 and 18 are plan views of the front face of each of two different strips illustrating examples of verbs of different tenses.

FIGS. 19 and 20 are plan views of the reverse side of each of the strips shown in FIGS. 17 and 18, illustrating the respective correct verb tense categories for each of the strips.

FIGS. 21 and 22 are plan views of the front face of each of two different strips illustrating examples of transitory words or phrases.

FIGS. 23 and 24 are plan views of the reverse side of each of the strips shown in FIGS. 21 and 22, illustrating the respective correct transitory categories for each of the strips.

FIGS. 25 and 26 are plan views of the front face of each of two different strips illustrating examples of synonyms or foreign language equivalents of preselected key words.

FIGS. 27 and 28 are plan views of the reverse side of each of the strips shown in FIGS. 25 and 26, illustrating the respective preselected key words for each of the strips.

FIGS. 29 and 30 are plan views of the front face of each of two different strips illustrating examples of types of sentences and portions of sentences.

FIGS. 31 and 32 are plan views of the reverse side of each of the strips shown in FIGS. 29 and 30, illustrating the respective correct type of sentence or portion of a sentence categories for each of the strips.

FIG. 33 is a plan view of the front face of a strip illustrating an unpunctuated sentence.

FIG. 34 is a plan view of the reverse side of the strip shown in FIG. 33, illustrating correct punctuation for that sentence.

In order to facilitate an understanding of this invention, it will be first described in its embodiment wherein the language categories are eight different parts of speech. As will be discussed in more detail hereinafter, various other types of categories and numbers of categories may be readily substituted for the parts of speech categories most fully illustrated herein.

Figure 1:
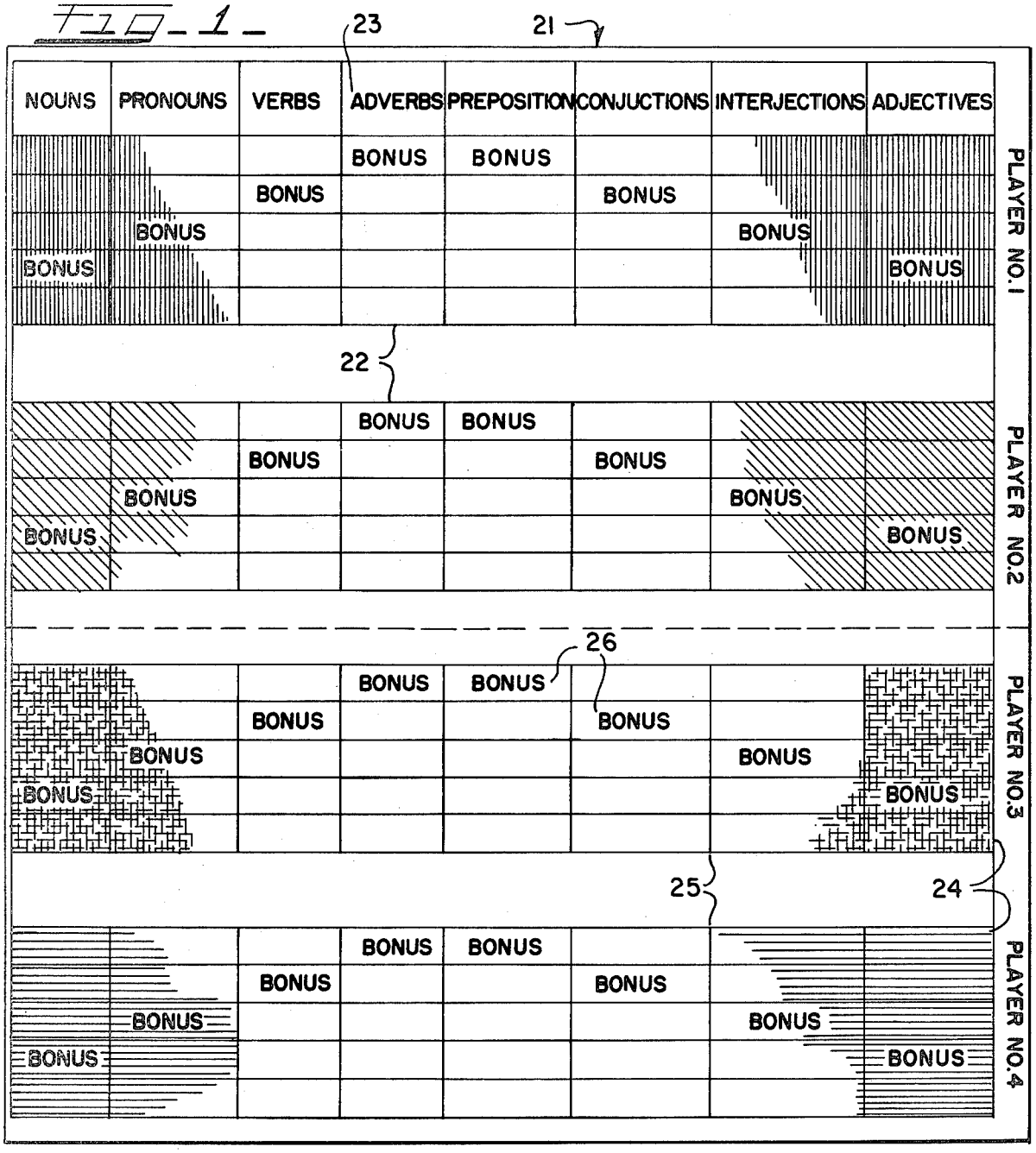
FIG. 1 is a plan view of the playing board, illustrating parts of speech as grammatical categories.
Figure 3:
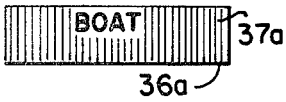
Figure 4:
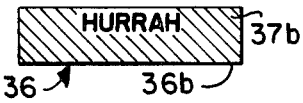
Figure 5:
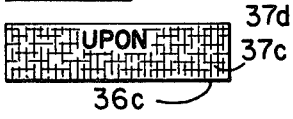
Figure 6:
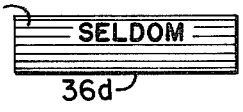
Figure 7:
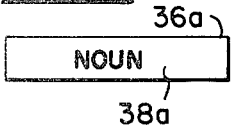
Figure 8:
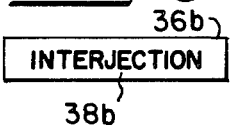
Figure 9:
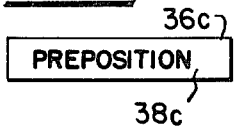
Figure 10:
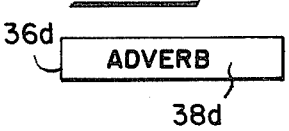

FIG. 1 illustrates a game board generally indicated by reference numeral 21, which includes a plurality of columns 22, eight columns being illustrated and being headed by eight different column categories 23. Also shown are a number of rows 24, the same number of rows being provided for each player area 25, there being illustrated five rows 24 in each of four different color coded player areas 25. Also included are bonus spaces 26 distributed throughout the various columns, each player area 25 preferably containing the same number of bonus spaces 26.

Figure 2:
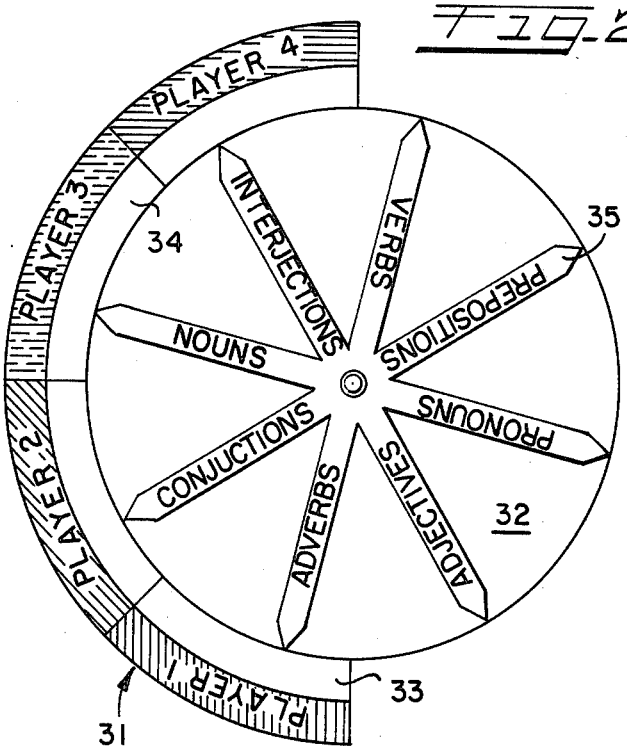
FIG. 2 is a plan view of the preferred indicator means, a spinner, illustrated for use with the parts of speech grammatical categories and for a maximum of four players.

FIG. 2 illustrates the indicator means, generally referred by reference numeral 31. The preferred indicator means 31 includes a spinner 32 rotatably mounted onto a designating surface 33 which includes a plurality of arcuate sections 34 for designating a player number. The spinner 32 includes a plurality of pointers 35, the indicator means 31 being sized such that only one of the pointers will point to any one of the colored arcuate sections 34. Indicator means 31 provides the ability to randomly select the grammatical or language category, indicated on the pointers 35, that each particular player, designated in the arcuate sections 34, is to select in order to gain points. The indicator means 31 shown is for use with four or fewer players; of course, it may be readily modified for use with more than four players by increasing the number of sections 34 and, if necessary, also the number of pointers 35.

FIGS. 3–10 illustrate the wording strips, generally indicated by reference numeral 36; more particularly, for the depicted embodiment numerals **36*a*, 36*b*, 36*c*, and 36*d* are indicated. Each front face, 37*a*, 37*b*, 37*c*, and 37*d*, thereof is color coded to designate the color associated with each player in his player area 25 (FIG. 1) and his arcuate section 34 (FIG. 2) and includes an example of a particular grammatical or language category, the illustrations showing words of different parts of speech. The rear face 38*a*, 38*b*, 38*c*, and 38*d* of each strip 36 identifies the part of speech category exemplified on the respective front face, said rear faces optionally being color coded also, if desired. The wording strips 36*a*, 36*b*, 36*c*, and 36*d* are preferably and most conveniently stored in an inclined tray, generally indicated by reference numeral 41, provided for each player. As illustrated in FIG. 11, the tray 41 includes one or more rearwardly inclined surfaces 42 having a plurality of slots 43 sized for accommodating the wording strips 36. The extent of the incline along surface 42, the sizing of the slots 43, and the sizing and placement of the lettering on strips 36 all preferably cooperate to hold and display the strips 36 in a manner such that the rear face 38 of each strip 36 is hidden from view, while the lettering on the front face 37 of each strip 36 is panoptically displayed for easy viewing and reading of the lettering on the front face and only on the front face of each strip 36**.

The dice, **44*a* and 44*b*, are illustrated in FIGS. 12 and 13 to show the six faces of each. The preferred dice, as illustrated, each include on two faces thereof, preferably opposite faces, the syllable "BO" and the syllable "NUS", while each of the remaining eight faces include a word or words, preferably corresponding to the grammatical or language categories of the particular game embodiment selected; in the drawings, the eight remaining surfaces of two dice 44*a* and 44*b* are printed with the eight parts of speech of the column categories 23 (FIG. 1). After the dice are thrown, the uppermost surfaces of each combine to provide a chance determination of the number of bonus points to be awarded when a player is able to enter a wording strip 36 into a bonus space 26**.

FIG. 14 illustrates a player number drawing card 45, the front face thereof being shown. Each such card 45 includes on its front face a player number designation 46 which is preferably combined with an appropriate color code for that player number and also a caricature illustration. The rear side (not shown) of every card 45 is identical, either being blank or of a singular design. Cards 45 facilitate the random selection of player numbers and color codes and designate which player area 25 and which set of wording strips 36 are to be used for each player. FIG. 15 shows a preferred score card, generally indicated by reference numeral 47, which includes a plurality of score card columns 48, one for each player, each column 48 further including game lanes 49 for recording the total points scored by each player in each game played. Also included are bonus lanes 51 for each game, a subtotal square 52, and a total section 53.

For purposes of illustration and disclosure, the functions of the game apparatus will become evident from the following detailed disclosures for certain embodiments in language or grammer categories. The first to be illustrated and the one to be illustrated in the greatest detail is the parts of speech embodiment.

The game begins by having each player select a player number and/or color code, preferably by selecting, face down, one of the player number drawing cards 45. Each player then receives all of the appropriately coded wording strips 36 that have a word lettered on the front face and the word's part of speech (grammer category) lettered on the rear face. Preferably, a total of forty wording strips 36 are available, including approximately equal numbers of word examples in each part of speech category. When the inclined trays 41 are provided, the strips 36 are inserted, front face forward, within the slots 43.

Player No. 1 spins the spinner 32 with the result that one of the pointers 35 rests adjacent the arcuate section 34 designated for player No. 1. If, for example, the "noun" pointer 35 rests adjacent arcuate section 34 for player No. 1, then player No. 1 surveys the front face of the various wording strips 36 in search of a word that is a noun. For example, player No. 1 could select the strip shown in FIG. 3 having the word "boat" and optionally also having an illustration of a boat. This strip 36, always keeping its rear face hidden, would then be placed into the player area 25 for player No. 1 on the game board 21. This being the first item in this particular part of speech category, player No. 1 would place strip **36*a* in the first or top row 24 of the column 22 having the "noun" column category 23. Player No. 1 would also have the option of passing, should he not wish to risk choosing an incorrect example of the randomly chosen part of speech. By passing, the player forfeits no future turns or privileges for challenging other players; he does, of course, lose the opportunity to score points on that particular turn. At the completion of each game being played, the strips 36** are turned over to expose their rear faces, points are awarded for correct matchings, and points are deducted for inaccurate ones.

Once player No. 1 has placed a strip 36 into the column and row he selects within his player area 25, other players may challenge his selection. Player No. 2 has the first opportunity to challenge, followed by player No. 3 and so forth. Should a challenge be made and should the challenge be correct in that player No. 1 had made an inaccurate selection, then the challenging player is permitted to remove that word from the player area 25 of player No. 1 and place it into the correct column and the next empty row, from top to bottom, of the correct column category 23 of the challenger's own player area 25. A determination of the correct selection is made by permitting the challenging player to view the rear face 38 of the strip 36. In the event that a player indicates a part of speech category not specified on the rear face of the particular strip 36, then he is allowed to consult a dictionary or a rule book provided with the apparatus to check whether or not the particular word selected could fall within more than one part of speech category, and if it does so fall into multiple categories, whether or not the category he selected is one of such categories. If it does fall into one of the other of said multiple categories, then this shall be deemed to be a correct selection. If, for example, the category selected by player No. 1 and also the category selected by the challenging player can both be authenticated by consulting a dictionary or the rule book, then the strip 36 remains in the player area 25 for player No. 1, and the challenging player is neither rewarded nor penalized.

Preferably, in the event that a challenging player makes an incorrect selection, the challenging player is penalized by losing his next turn. It is possible that player No. 1 might have made an incorrect selection and that the challenging player likewise had made an incorrect selection. When this happens, player No. 1 is permitted to place that strip 36 into the correct column 2 of his player area 25, thus avoiding a deduction of points upon completion of the game. It is also possible that player No. 1 made an incorrect selection which was not challenged, which means that non-matching strip 36 will remain within player area 25 for player No. 1 at the completion of the game, at which time points will be deducted from player No. 1 for this incorrect answer. Thus, player No. 1 is penalized for an incorrect selection, a challenging player is rewarded for a correct challenge, and player No. 1 is rewarded while a challenging player is penalized for an incorrect challenge.

Should the particular row and column that is filled by a strip 36 be designated as a bonus space 26, and should that space remain filled after all challenges, then the player filling the space is entitled to throw the dice. Should there have been a challenge, and if that challenge was successful, then the challenging player is entitled to throw the dice, even if the row and column that he fills within his own player area 25 is not a bonus space 26. Bonus points are calculated as follows. If one of the dice 44, after having been rolled, shows the syllable "BO" and the other one shows the syllable "NUS", then that player is awarded a point maximum, preferably fifteen points. Should each of the thrown dice show two complete words (e.g. two parts of speech), then he gets the second highest point total, preferably ten points. Should one of the two dice show a syllable and the other show a word, then the player gets a third highest number of points, preferably five, while if a player throws dice that come up "BO" and "BO" or "NUS" and "NUS", he gets the least number of points, preferably zero.

Each game automatically terminates when the first one of the players fills an entire row, meaning that he has inserted and been able to retain at least one strip 36 under each of the column categories 23; that is, he has received credit for correctly identifying an example of each part of speech or other category. Each game may optionally be terminated by a player, preferably by saying "abort", when he has filled any one of the columns 22, generally meaning that he has been given credit for correctly identifying five examples of the same part of speech or other category.

In either event, after each game is terminated, the point totals are calculated, preferably through the aid of score card 47. In the preferred scoring arrangement, each filled column is awarded ten points, and should that column include any incorrect selections, two points are subtracted for each such wrong selection. Each completed row is awarded 25 points, with two points being subtracted for each incorrect selection. No points are awarded for incomplete rows or columns. The subtotal is entered in the appropriate square 52. Added thereto are all bonus points earned during that particular game, the total being entered into an appropriate total section 53. Generally, the first player to reach 100 points or more is declared the winner of the series of games. Should two or more players achieve 100 or more points at the conclusion of the same game, then the winner of the series of games will be determined by the highest point total over 100.

When, as exemplified previously herein, this invention is used in connection with parts of speech categories, the preferred parts of speech used are "nouns, pronouns, verbs, adverbs, prepositions, conjunctions, interjections, and adjectives." Substantially identical structure of the preferred apparatus can be used with a variety of other categories, with appropriate examples thereof being lettered onto similar wording strips 36. One other such category is that of verb tenses, preferably including present, future, past, present infinitive, past participle, past perfect, present perfect, and future perfect tenses. Illustrations are given in FIGS. 17, 18, 19 and 20, showing representative strips **56*a* and 56*b* having front faces 57*a* and 57*b* as well as rear faces 58*a* and 58*b*. Other tenses or noun cases for English pronouns and nouns or other parts of speech in other languages may likewise be selected. Such alternative categories would be included in the column categories 23 of the game board 21, within the arcuate sections 34 of the indicator means 31, on the rear faces 38 of the wording strips 36, and, alternatively, on appropriate faces of the dice 44*a* and 44*b***.

Another contemplated category grouping is of different types of transitory words and phrases falling within general classifications; such as, addition or continuation, contrast or alternative, exemplification or illustration, similarity, conclusion or result, concession, summary conclusion, and emphasis. Illustrations in this regard are shown in FIGS. 21, 22, 23 and 24 which depict typical strips **66*a* and 66*b* having front faces 67*a* and 67*b* as well as rear faces 68*a* and 68*b*. Again, these categories would be substituted, perhaps by means of removable labels, such as magnetic or pressure sensitive labels, on each of the board 21, the indicator means 31**, the wording strips 36, and the dice 44. On the whole, such revisions to the dice are least important since the bonus calculations are made on the basis of combinations of complete words and/or syllables, there being no need to have the same categories on the dice as are on the remainder of the game. It is intended that these variations can be accomplished in a game apparatus as a whole, rather than having to provide a totally separate game apparatus set for each alternative type of language of categories. In most instances, it is preferred to provide a number of sets of different wording strips 36 for each type of game category because of their volume and relatively small size.

Another variation is to have the game apparatus deal with synonyms. This is accomplished by selecting any number, usually eight, of different "key" words as the categories, with the "examples" thereof being words or phrases that are generally synonymous with one of the key words. This allows for the provision of categories and examples thereof, which precisely fits the pattern previously discussed in connection with the grammer category embodiments. This is useful in developing vocabulary skills and may even be adapted to learning non-English "equivalents" of "key" words in a language. FIGS. 25 and 27 illustrate a synonym strip 76*a* having a front face 77*a* and a rear face 78*a*, and FIGS. 26 and 28 illustrate foreign language equivalents by strip 76*b* having a front face 77*b* and a rear face 78*b*.

Still another variation in application of the present game apparatus is varying the point value attributed to the matches on the wording strips 36 by specifying varying point values on the front faces 37 thereof. Preferably, in this variation illustrated in FIG. 11, the strips will be arranged in tiers on the inclined tray 41, such that the strips having the highest point total are near the top, and those having the lowest point total are near the bottom. For example, the point totals may range from one point up through eight points, generally indicating an increasing degree of difficulty of the match required for a correct answer. This means that the number of points awarded for a complete column or row will vary, depending upon the point value for the various strips within that column or row. And, for example, in the event that a row or column contains one or more incorrect answers totalling a relatively high value, this could mean that the actual number of points awarded for a complete column or row would be a negative value. A particularly suitable category type for use with this variation is one arranged according to English language sentence type or sentence fragment type. An example of a preferred set of such types is: phrase, clause, interrogative sentence, exclamatory sentence, declarative sentence, compound sentence, complex sentence, and imperative sentence. The embodiment is illustrated in FIGS. 29, 30, 31 and 32 by strips 86*a* and 86*b* having front faces 87*a* and 87*b* as well as rear faces 88*a* and 88*b*. Sentence types in other languages also may be selected.

It is also possible to vary the game apparatus in order to use punctuation marks as the categories. With this alternative, the punctuation marks may include a question mark, a colon, a semicolon, a period, a comma, a quote, an exclamation point, and a hyphen or an apostrophe. In this variation illustrated in FIGS. 16, 33 and 34, the indicator means 31′ is first spun, the pointers 35′ thereof parcelling out to each player number in the respective arcuate section 34′ one or more possible punctuation categories. Then, an unpunctuated sentence is provided on a wording strip 36′, and each player proceeds in numerical order to indicate whether or not the punctuation category or categories assigned to him can be used in the sentence and the appropriate location thereof within the unpunctuated sentence.

Each player may use only the punctuation mark or marks parcelled out to him by the pointer 35′. The pointers and the designating surface 33′ are arranged such that all of the possible punctuation marks are available to the total number of players. This means that, for example, when two players are playing and when eight punctuation marks are possible, each pointer will designate at least four different punctuation marks; when three players are playing and nine punctuation marks are available, each pointer will show at least three punctuation marks, and when four players are playing with eight available punctuation marks, each pointer will include at least two punctuation marks (FIG. 16). The correct match of punctuation mark with sentence and sentence location will entitle the player to place a strip containing that sentence into the appropriate space within his player area 25. Since more than one player may be entitled to a correct answer or more than one correct answer for each sentence, multiple identical wording strips 36′ should be provided for placing in the appropriate locations. Alternatively, a modified form of score card or game board may be provided (not shown) to record the punctuation selections for each player.

Other variations of the manner of using the apparatus of this invention, including variations in the illustrative rules of play and other embodiments may be made without departing from the spirit of the present invention. Accordingly, this invention is to be construed and limited only by the scope of the appended claims.

I claim:

1. A game apparatus, comprising: a plurality of strips having two faces, one of said faces being a front face having thereon a word or combination of words exemplifying a language category, the other face being a rear face having a word or words identifying the language category exemplified on said front face;

a game board having a plurality of spaces oriented in a plurality of rows and a plurality of columns for receiving and accumulating said strips according to each of said language categories, certain preselected ones of said spaces on the game board having a designation therein for rewarding bonus points;

an indicator means for random selection of any one of said language categories; and dice, each of which has words or syllables on its face for determining by change an amount of bonus points to be rewarded upon receiving and accumulating one of said strips upon one of said certain preselected spaces of said game board.

2. The apparatus of claim 1, wherein the language categories are punctuation marks, and the indicator means have a plurality of pointers which, at any one position of the pointers with respect to total designating surface of the indicator means, total all of the punctuation mark categories.

3. The apparatus of claim 1, wherein said indicator means matches a readable representative of one of said language categories with a number designating a player.

4. The apparatus of claim 1, further comprising an inclined tray having support means for holding said strips and for panoptically displaying said front side without displaying said rear side of each strip.

5. The apparatus of claim 1, wherein each of said dice have a syllable on two faces and have a different language category word on the remaining faces.

6. The apparatus of claim 1, wherein said language categories are parts of speech.

7. The apparatus of claim 1, wherein said language categories are the tenses of verbs.

8. The apparatus of claim 1, wherein the language categories are transitory words or phrases.

9. The apparatus of claim 1, wherein the language categories are synonyms or foreign language equivalents of preselected key words.

10. The apparatus of claim 1, further comprising an inclined tray having support means for holding said strips and for panoptically displaying said front side without displaying said rear side of each strip.

11. The apparatus of claim 10, wherein the language categories are types of sentences and portions of sentences.

12. The apparatus of claim 10, wherein said tray has tiers of various point values, and the front face of each of said plurality of strips has a corresponding point value thereon.

* * * * *

UNITED STATES PATENT AND TRADEMARK OFFICE

CERTIFICATE OF CORRECTION

PATENT NO. : 4,171,816

DATED : October 23, 1979

INVENTOR(S) : Gene C. Hunt

It is certified that error appears in the above-identified patent and that said Letters Patent are hereby corrected as shown below:

Column 4, line 35, "grammer" should be --grammar--.

Column 7, line 17, "examples" should be --"examples"--.

Column 7, line 21, "grammer" should be --grammar--.

Column 5, line 42, "2" should be --22--.

Signed and Sealed this

*Twenty-second* Day of *April 1980*

[SEAL]

*Attest:*

SIDNEY A. DIAMOND

*Attesting Officer*

*Commissioner of Patents and Trademarks*